US006604838B2

(12) United States Patent
Jautz

(10) Patent No.: US 6,604,838 B2
(45) Date of Patent: Aug. 12, 2003

(54) ILLUMINATED DISPLAY COLUMN

(75) Inventor: Karl Jautz, Denia Alicante (ES)

(73) Assignee: Karl Jautz Elektrotechnische Spezialfabrik KG, Plochingen (DE)

( * ) Notice: Subject to any disclaimer, the term of this patent is extended or adjusted under 35 U.S.C. 154(b) by 0 days.

(21) Appl. No.: 10/092,721

(22) Filed: Mar. 8, 2002

(65) Prior Publication Data

US 2002/0172040 A1 Nov. 21, 2002

(30) Foreign Application Priority Data

Mar. 10, 2001 (DE) ..... 101 11 594

(51) Int. Cl.[7] ..... F21S 3/00

(52) U.S. Cl. ..... 362/225; 362/219; 362/226; 362/238; 362/249; 362/251; 439/367; 439/368; 439/369

(58) Field of Search ..... 362/219, 226, 362/238, 249, 251; 340/907; 439/367, 368, 369

(56) References Cited

U.S. PATENT DOCUMENTS 5,428,516 A * 6/1995 Harris ..... 362/226
5,752,760 A * 5/1998 Dealey et al. ..... 362/551
5,964,518 A * 10/1999 Shen ..... 362/225
6,343,870 B1 * 2/2002 Chang ..... 362/227

* cited by examiner

*Primary Examiner*—Sandra O'Shea
*Assistant Examiner*—James W Cranson, Jr.
(74) *Attorney, Agent, or Firm*—Jones, Tullar & Cooper, P.C.

(57) ABSTRACT

The invention relates to a display lamp with lamp sections, which are releasably arranged one above the other and wherein each comprises a transparent housing section with an insertion unit. The insertion unit has electrical conductors, which are connected via electrical connecting structure with the conductors of the respective insertion units arranged below or on the base of the display lamp. Furthermore the insertion units provide receiving devices for the display lamps, which are connected with the conductors. The connecting structure comprise pins and sockets extending in the axial direction. One lamp section can be axially plugged into the lamp section or base respectively arranged below it in such a way that the pins and sockets connect the conductors of the insertion unit with the conductors, arranged respectively below, of the insertion unit located below, wherein the lamp sections are connected via snap-in connections with the lamp section or base respectively located below it.

6 Claims, 4 Drawing Sheets

ILLUMINATED DISPLAY COLUMN

FIELD OF THE INVENTION

The invention relates to a display lamp with lamp sections, which are releasably arranged one above the other and wherein each comprises a transparent housing section with an insertion unit, wherein the insertion unit has electrical conductors, which are in connection via electrical connecting means with the conductors of the respective insertion units arranged below or on the base of the display lamp, and wherein furthermore the insertion units provide receiving devices for the display lamps, which are connected with the conductors.

PRIOR ART

Display lamps of this type are known from German Patent, DE 22 11 801 B2. For assembling the display lamp, the individual lamp sections are mounted to each other by twisting. The conductors of the insertion units arranged one above the other are connected with each other by the twisting movement.

But the known display lamp has the disadvantage that the number of the lamp sections is limited. Based on the twisting movement and the contacting of the individual conductors occurring along with it, and based on the restricted space conditions, it is possible to arrange maximally five to seven lamp sections on top of each other.

SUMMARY OF THE INVENTION

The object of the present invention is therefore based on providing a display lamp wherein the individual lamp sections can be handled separately of each other, without the number of the lamp sections arranged one above the other being limited.

This object is attained in accordance with the invention by a display lamp of the type mentioned at the outset in that the connecting means comprise pins and sockets extending in the axial direction, and that one lamp section can be axially plugged into the lamp section or base respectively arranged below it in such a way that the pins and sockets connect the conductors of the insertion unit with the conductors, arranged respectively below, of the insertion unit located below, wherein the lamp sections are connected via snap-in connections with the lamp section or base respectively located below it.

This has the advantage that the number of lamp sections arranged one above the other is not limited because of the connection with adjoining lamp sections. Instead, it is possible to provide any desired number of lamp sections above each other, only limited by the number of conductors. In accordance with the invention, the individual lamp sections are therefore exclusively mounted in the axial direction; twisting of the lamp sections for mounting, such as is required by the prior art, is no longer necessary. Moreover, a quick and simple exchange of the individual lamp sections is possible because of the snap-in connections in accordance with the invention.

In accordance with the invention, flashing lamps, blinking lamps, LEDs or the like can be used as display lamps.

A preferred embodiment of the invention is distinguished in that each lamp section has a switching means, through which a defined display function is assigned to the display lamp of the respective lamp section. Such a switching means, for example a rotary switch, a plug-in switch or a switch embodied in a different way, has the advantage that a conductor with a defined display function is assigned to a lamp section of a defined color. By adjusting the switching means it is then accordingly possible to change the display function, or the connection of the display lamp with a conductor. Based on this adjustment to be performed at the lamp section, it is assured that the display function assigned to a lamp section is always the same, regardless of the assembled sequence of the lamp sections. In this way it is prevented that, because of an erroneous sequence of the lamp sections during the assembly of the illuminated display, display functions are provided by lamp sections not intended for this. If the switching means of two or more lamp sections have the same switching position, these lamp sections emit a signal simultaneously. In this way several lamp sections can be used for an intended display function.

In a further embodiment of the invention it is provided that the insertion units in the areas of the two front faces of the lamp sections each have a plate, wherein the two plates are connected with each other by means of the conductors, that the switching means is arranged on one of the plates, and that the pins and/or sockets are provided on the side of the plates which are respectively facing away from the other plate. The positionally accurate arrangement of the pins and/or sockets in the area of the front faces of the lamp sections is assured by this in a simple manner.

In accordance with the invention, a receiving device for the display lamp can be provided on one of the plates. The switching means is advantageously also arranged on the plate on which the receiving device is arranged. In this way unnecessary wiring outlay inside the insertion unit is avoided.

Moreover, other electrical components, which optimize the display function, can also be provided on the plates. For example, such components cause a defined triggering of the display lamps, so that the display lamps emit a blinking or flashing signal, for example.

It can furthermore be provided that the insertion units each contain a bottom plate. By means of the bottom plate it is possible, for example, to fix the two plates in place on the conductors inside a lamp section and to hold them. In accordance with the invention, the receiving device for the display lamp can also be provided on the bottom plate.

For assuring the connection of the respective lamp sections with each other in a simple manner, the snap-in connections have snap-in and insertion means, preferably arranged in the area of the front faces of the transparent housing sections. Insertion inlets and insertion protrusions, which can be resiliently inserted into the insertion inlets, are particularly considered as snap-in and insertion means.

It is also conceivable in accordance with the invention that a section is provided with an acoustic signal instead of or in addition to a lamp section with a display lamp. This has the advantage that, besides the optical signals, acoustic signals can be emitted by the display lamp. Such a signal section is preferably also provided with a switching means with which it is possible to select which conductor is to be assigned to it. With an identical switched position of the switching means of the acoustic signal section and a lamp section, the acoustic signal emitter provides a signal at the same time with the respective lamp section.

BRIEF DESCRIPTION OF THE DRAWINGS

Further advantageous embodiments and details of the invention can be taken from the following description, in which the invention is described in greater detail and explained by means of the exemplary embodiment represented in the drawings.

DESCRIPTION OF THE PREFERRED EMBODIMENTS

Figure 1:
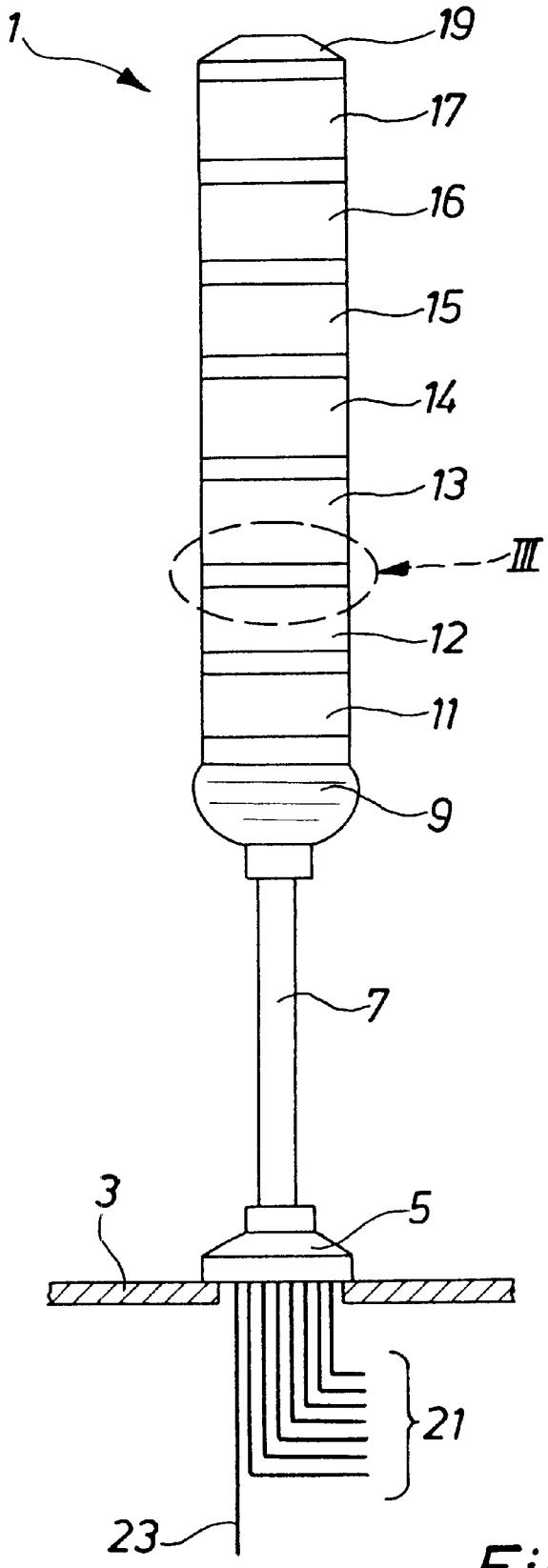
FIG. 1, is a display lamp column in accordance with the invention in a lateral view.

FIG. 1 shows a display lamp column 1 arranged on a machine frame 3. A base 5 has been mounted on the machine frame 3, on which a cylindrical standpipe 7 is mounted. The standpipe 7 has a base 9, on which seven lamp sections 11 to 17 are arranged. The uppermost lamp section 17 is covered by means of a cap 19.

FIG. 1 moreover shows seven supply conductors 21, which feed current to the display lamps of the individual lamp sections 11 to 17. A further conductor 23 is provided as a discharge conductor. The individual lamp sections 11 to 17 are provided with current over the seven supply conductors 21.

Figure 2:
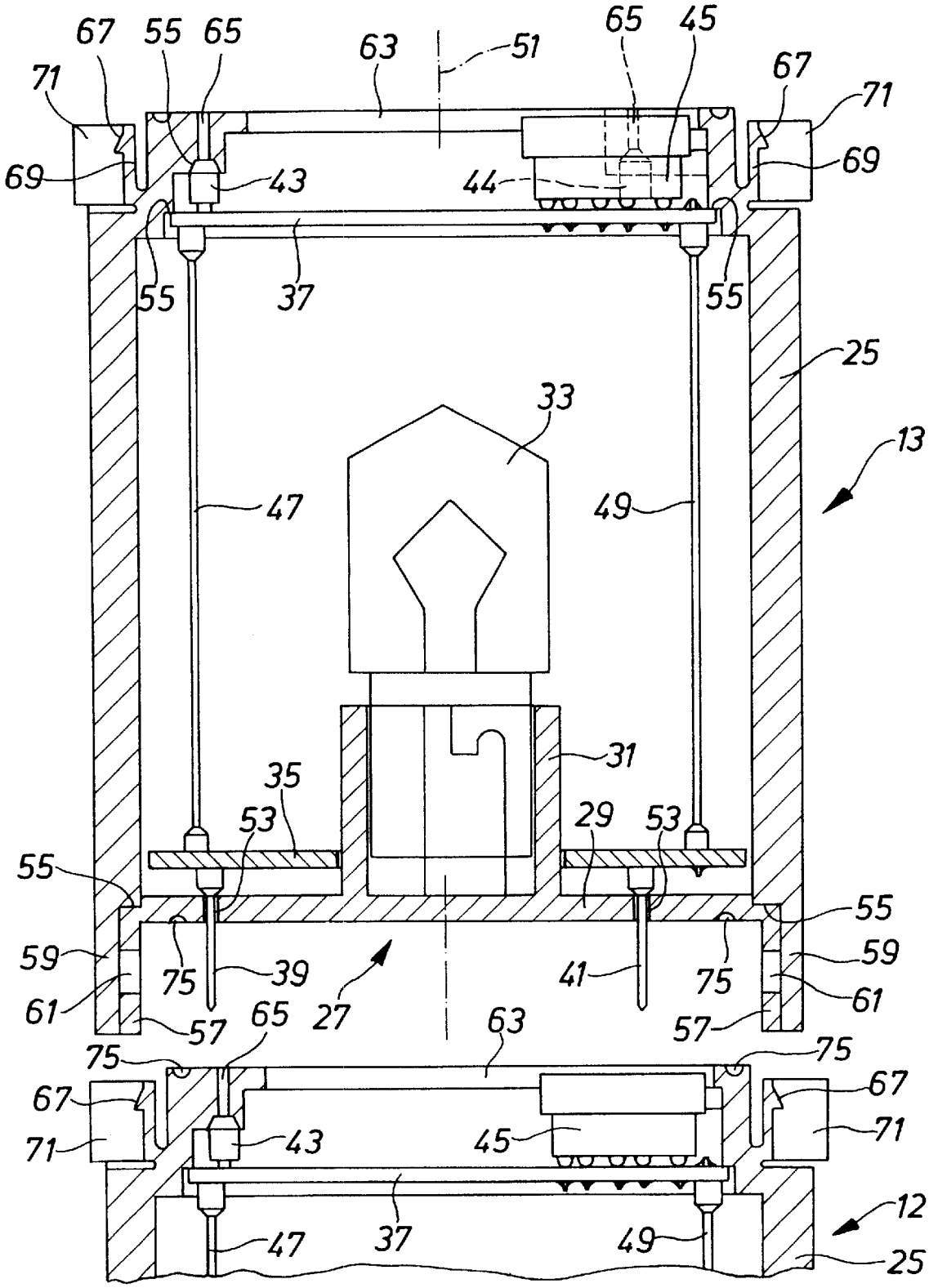
FIG. 2, is a longitudinal section through lamp sections of the display lamp column, arranged one above the other, in accordance with FIG. 1, in the unassembled state.

The lamp section 13 is represented in an axial longitudinal section in FIG. 2. The lamp section 13, which corresponds to the other lamp sections 11, 12 and 14 to 17, has a transparent housing section 25. Preferably the transparent housing sections 25 of the individual lamp sections 11 to 17 are of different colors so that, depending on the triggering of a lamp section 11 to 17, a desired signal can be emitted by means of its color.

An insert unit 27, which includes a bottom plate 29 with a socket for a display lamp 33, two plates 35 and 37, as well as the conductor sections 47 and 49, which connect the two plates 35 and 37, has been placed into the housing section 25. Each one of the two plates 35 and 37 has two rows of pins placed one behind the other, which are identified by the reference numerals 39 and 41. Two rows of four sockets, arranged one behind the other, which have the reference numerals 43 and 44, are correspondingly provided on each of the plates 35 and 37. The bottom plate 29 and the two plates 35 and 37 are arranged perpendicularly in relation to the axis 51 of the lamp section 13. The plate 35 is arranged in the area of the bottom plate 29; the plate 37 in the area of the upper front face of the housing section 25. The conductors 47 and 49, which connect the two plates 35 and 37 with each other, extend axially to the right and left next to the display lamp 35, and each has advantageously at least four strands of wires.

The free ends of the conductor sections 47 and 49 are advantageously soldered to the respective plate 35, or 37.

The eight pins 39 and 41 extending in the axial direction project through openings 53 in the bottom plate in the direction facing away from the lamp element 33.

A switching means in the form of a rotary switch 45 is furthermore arranged on the upper plate 37, over which the strands of wires of the wire sections of the conductors 47 and 49 are assigned to the respective lamp 33. Advantageously the rotary switch 45 has an actuating slit on its top, through which the rotary switch 45 can be set with the aid of a screwdriver.

For mounting a lamp section, the insert units 27 are axially pushed from below into the transparent housing sections 25. The insertion units 27 themselves can be completely preassembled in this case; but it is also conceivable that, for example, the plates 35 and 37 with the conductor sections 47 and 49 and the pins 39, 41, as well as the sockets 43 and 44, are axially inserted as separate components into the housing section 25.

In the next work step the bottom plate 29 with the socket 31 is introduced into the respective housing section 25. For assuring a positionally exact arrangement of the individual components of the insertion unit 27 in the housing section 25, the housing section 25 provides different contact sections 55, on which the individual components of the insertion unit 27 are supported. Incidentally, the bottom plate 29 has an edge section 57 extending in the axial direction, which is arranged with an exact fit in the section 59 of the housing section 25 surrounding it. The edge section 57 furthermore has two oppositely located insertion inlets 61, which are a part of a snap-in connection with the lamp section 12 arranged below it.

At the upper front face the housing section 25 has an opening 63 of large size and axial openings 65, each leading to the sockets 43 and 44.

The transparent housing section 25 furthermore provides two insertion protrusions 67 in the edge area of the front face with the opening 63. Each of the insertion protrusions 67 is arranged on a spring-elastic tongue 69, which can be elastically deformed via respective actuating sections 71.

As represented in FIG. 2, the portion of the lamp section 12 shown corresponds to the corresponding portion of the lamp section 13. For connecting the two lamp sections 12 and 13, the lamp section 13 is axially pushed onto the lamp section 12. In the process, the four pins 39 of the section 13 are inserted into the opening 65, or in the four sockets 43 of the section 12. The four pins 41 of the section 13 are correspondingly inserted into the four sockets 44. To connect the two lamp sections 12 and 13, the insertion protrusions 67 of the section 12 snap into the insertion inlets 61 of the bottom plate 29 of the lamp section 13.

Figure 3:
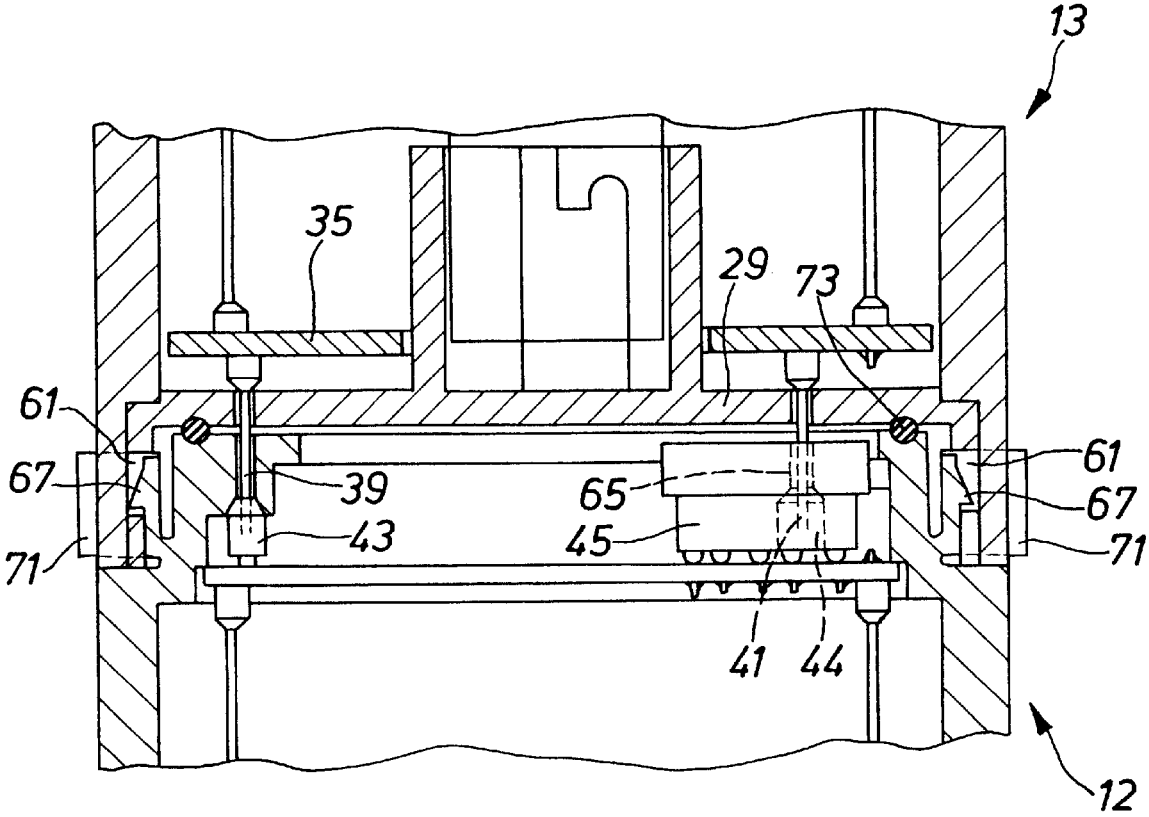
FIG. 3, is a portion of two lamp sections connected with each other.

Portions of the lamp sections 12 and 13 mounted on each other are represented in an axial longitudinal section in FIG. 3. It can be clearly seen how the insertion protrusions 67 are seated in the corresponding insertion inlets 61. A seal ring 73 is furthermore represented, which is seated in recesses 75 provided for this purpose in the bottom plate 29 of the lamp section 13, or on the front face of the housing section 25 of the lamp section 12.

For releasing the lamp sections 12 and 13 connected with each other by means of the snap-in connection, the two actuating sections 71 are radially pushed in the direction toward the axis 51. By means of this the two insertion protrusions 67 are moved out of the insertion inlets 61. Thus, the two lamp sections 12 and 13 can be dismounted in the axial direction.

Figure 4:
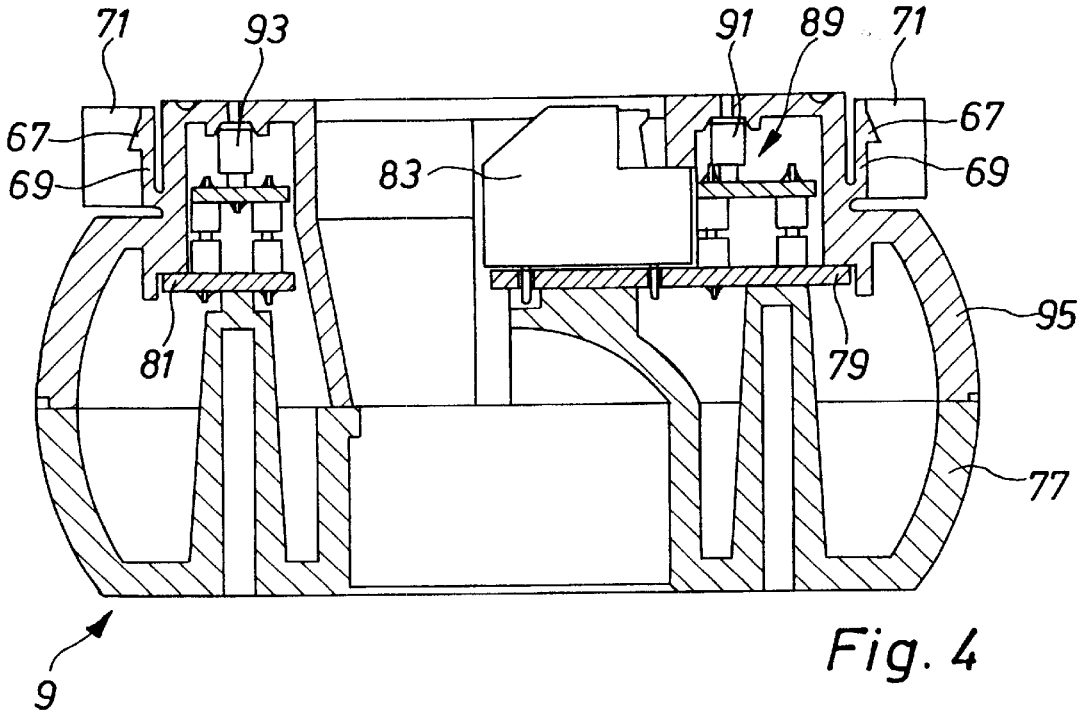
FIG. 4, is the base of the display lamp column in accordance with FIG. 1 in section.
Figure 5:
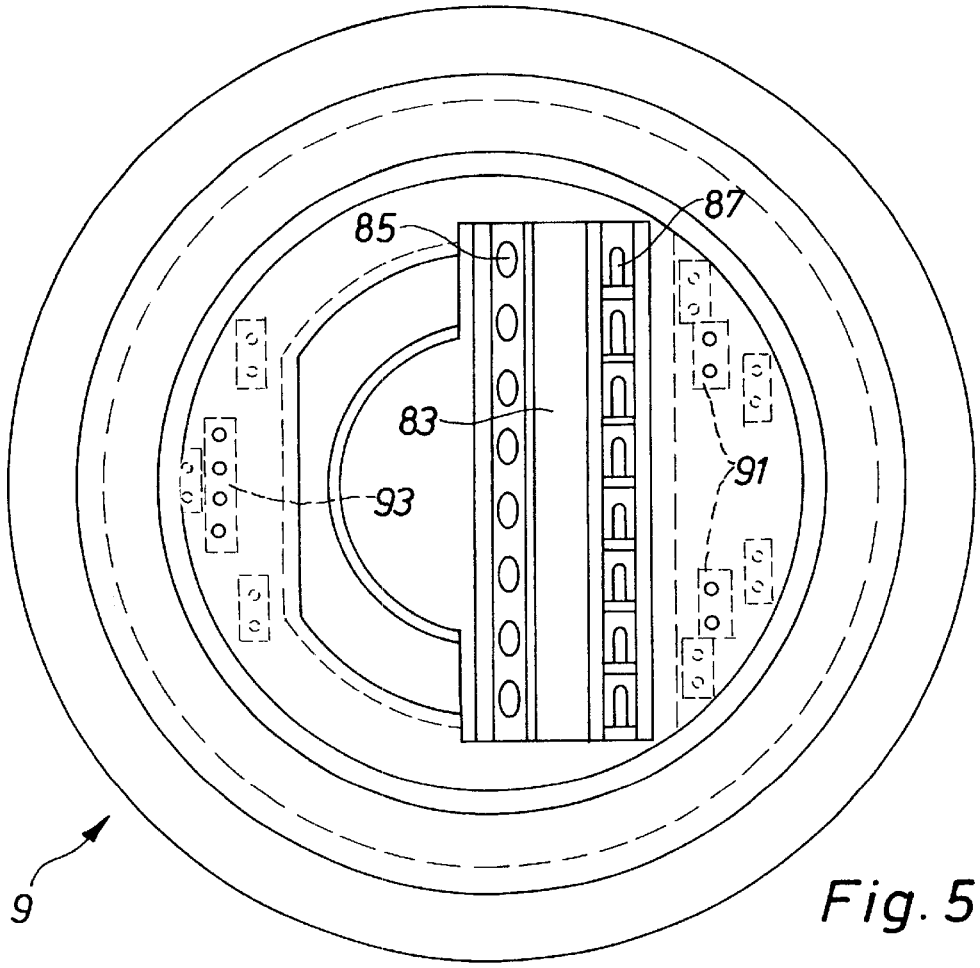
FIG. 5, is a view from above on the base in accordance with FIG. 4.

FIGS. 4 and 5 show a base 9 made in two parts. The lower partial section 77 of the base 9 can be provided for being arranged on a machine or, as represented in FIG. 1, on the free end of a standpipe. In this case the partial section 77 supports two plates 79 and 81. A connecting terminal block 83, which is provided for connection with the conductors 21 and 33, has been soldered on the plate 79. The individual terminal screws 85 and terminal receivers 87 for the free ends of the conductors 21 and 33 can be seen in the view from above represented in FIG. 5. Various other components 89 are present on the plate 79, which include four sockets 91. In the assembled state, the four pins 41 project into the four sockets 91.

Various components 89 are also provided on the plate 81, which include four sockets 93 which, in the mounted state, receive the four pins 39.

The plates 79 and 81, as well as the components 89 with the sockets 91 and 93, are covered by an upper partial element 95 of the base 9. Insertion means corresponding to the lamp sections 11 to 17 are furthermore provided in the upper partial element 95. The insertion means comprise two oppositely located insertion protrusions 67 arranged on tongues, as well as two actuating sections 71.

For assembling the display lamp 1, the lamp section 11 alone, or together with the further lamp sections 12 to 17, is placed on the base 9. In the process the eight pins 41 and 39 of the lamp section 11 contact the eight sockets 93 and 91.

In the assembled state, the individual lamp sections 11 to 17 differ only by different colors of the individual housing sections and by the position of the respective rotary switches 45. Each lamp section 11 to 17 is assigned a corresponding supply conductor 21, or 47, 49, by means of the switch setting of the rotary switch 45. Therefore the lamp sections 11 to 17 emit preset signals independently of each other and independently of the sequence in which they were mounted.

In accordance with the invention it is conceivable that several lamp sections are provided with the same switch setting of the respective rotary switch 45. This has the result that, because of their assignment to the same supply conductor, the display lamps of these synchronized lamp sections are illuminated at the same time.

Seven supply conductors 21 and one discharge conductor 23 are provided for the display lamp column 1 described by way of example in the drawings. Accordingly, seven different signals can be sent by means of the column 1. If lamp sections with identical switch positions of the respective rotary switches are provided, these lamp sections sent signals at the same time. It is therefore conceivable to provide more than a total of seven lamp sections 11 to 17, in which case several sections are illuminated at the same time.

In accordance with the invention it can furthermore be provided that in addition—or also instead of a lamp section—an acoustic signal emitter is provided. Such an acoustic signal emitter has pins and sockets corresponding to the lamp sections 11 to 17, as well as corresponding rotary switches. A siren is provided in place of a display lamp 33. With the same switch position as an existing lamp section, an acoustic and an optical signal are emitted at the same time.

All characteristics represented in the specification, the subsequent claims and the drawings can be important for the invention individually, as well as in any desired combination with each other.

What is claimed is:

1. An illuminated display column, comprising a plurality of lamp sections releasably arranged one above the other, each lamp section having:

a transparent housing;

an insertion unit mounted to said transparent housing, said insertion unit having electrical conductors, and a receiving device defining an axial direction, for receiving a display lamp which when received is connected to said electrical conductors;

electrical connecting means comprising pins and sockets which extend in said axial direction, which are adapted to be connected to pins and sockets of adjacent lamp sections, and which when connected produce an electrical connection with said electrical conductors of the respective adjacent lamp sections; and snap-in connecting means, wherein one lamp section can be axially plugged into an adjacent lamp section by said snap-in connecting means, and as such said electrical conductors of said adjacent lamp sections are electrically connected.

2. The illuminated display column as defined in claim 1, wherein each lamp section further having:

switching means through which a defined conductor of said electrical conductors, and therefore a defined display function is assigned to the display lamp of the respective lamp section.

3. The illuminated display column as defined in claim 2, wherein each lamp section further having:

spaced apart plates connected to each other by said electrical conductors, wherein said switching means is arranged on one of said plates, and wherein said pins and/or sockets are provided on the side of said plates facing away from the other plate.

4. The illuminated display column as defined in claim 1, wherein each insertion unit has a bottom plate.

5. The illuminated display column as defined in claim 1, wherein said snap-in connecting means have snap-in and insertion means arranged in the area of the front faces of said transparent housing.

6. The illuminated display column as defined in claim 1, wherein instead of or in addition at least one lamp section of said plurality of lamp sections is provided with a section having an acoustic signal emitter.

* * * * *